US010407228B2

(12) United States Patent
Yehuda

(10) Patent No.: US 10,407,228 B2
(45) Date of Patent: Sep. 10, 2019

(54) FABRIC FOLDING APPARATUS

(71) Applicant: Ori Yehuda, Los Angeles, CA (US)

(72) Inventor: Ori Yehuda, Los Angeles, CA (US)

( * ) Notice: Subject to any disclaimer, the term of this patent is extended or adjusted under 35 U.S.C. 154(b) by 323 days.

(21) Appl. No.: 15/468,035

(22) Filed: Mar. 23, 2017

(65) Prior Publication Data

US 2018/0273265 A1 Sep. 27, 2018

(51) Int. Cl.

| | |
|---|---|
| ***B65D 75/14*** | (2006.01) |
| ***B65B 11/00*** | (2006.01) |
| ***B65B 63/04*** | (2006.01) |
| ***B65B 7/16*** | (2006.01) |
| ***B65D 25/54*** | (2006.01) |

(52) U.S. Cl.

CPC ..... *B65D 75/14* (2013.01); *B65B 63/045* (2013.01)

(58) Field of Classification Search

CPC ..... B65B 11/004; B65B 11/00; B65B 63/04; B65B 63/045; B65B 7/16; B65D 75/14; B65D 25/54; B65D 5/327; B65D 5/4801; D06F 89/005; D06F 89/02

USPC ..... 53/429, 456; 206/472, 278, 292, 297; 223/37, 38

See application file for complete search history.

(56) References Cited

U.S. PATENT DOCUMENTS 2,467,421 A * 4/1949 Blazek ..... B65D 75/14 206/289
2,925,175 A * 2/1960 Williamson ..... A47G 25/54 206/499
3,664,572 A * 5/1972 Puchkoff et al. ..... B65D 5/18 229/103.2
4,342,392 A * 8/1982 Cox ..... A61F 15/001 128/855
5,011,052 A * 4/1991 Craig ..... D06F 89/023 223/37
5,947,349 A 9/1999 Shaalan
5,947,366 A * 9/1999 Feldmann ..... B65D 85/182 206/278
5,954,202 A * 9/1999 Mellon ..... B65D 75/14 206/462
6,056,170 A 5/2000 Lizarbe
8,714,418 B2 * 5/2014 Kumar ..... D06F 89/02 223/37
2008/0264983 A1 * 10/2008 Kastan ..... D06F 89/005 223/38
2009/0277138 A1 11/2009 Smith et al.
2012/0228340 A1 9/2012 Sakane et al.
(Continued)

FOREIGN PATENT DOCUMENTS

CN 102409524 4/2012
CN 202688732 1/2013
(Continued)

*Primary Examiner* — Andrew M Tecco
*Assistant Examiner* — Nicholas E Igbokwe

(57) ABSTRACT

A fabric folding article includes guide sections, cover section, and fold sections, cooperating to fold, place, and secure a fabric article inside the apparatus. The guide sections comprise three sections and folding sections comprise four sections cooperating to fold and place the article within the apparatus. The cover sections operate to secure the fabric article within the apparatus. The entire apparatus is made from a single material. Alternatively, the guide sections and the cover sections are made from a first flexible material and the fold sections are made from a second flexible material.

7 Claims, 5 Drawing Sheets

(56) References Cited

U.S. PATENT DOCUMENTS

| | | | | |
|---|---|---|---|---|
| 2014/0091114 | A1* | 4/2014 | Paez | A45C 13/03 223/37 |
| 2014/0158723 | A1* | 6/2014 | Breier | D06F 89/023 223/38 |
| 2014/0305973 | A1 | 10/2014 | Hwang | |
| 2017/0035209 | A1* | 2/2017 | Greenberg | B65D 5/4208 |
| 2017/0340806 | A1* | 11/2017 | Dittrich | B65D 75/14 |

FOREIGN PATENT DOCUMENTS

| | | |
|---|---|---|
| CN | 203514082 | 4/2014 |
| WO | WO2011109893 | 9/2011 |

* cited by examiner

FABRIC FOLDING APPARATUS

COPYRIGHT

A portion of the disclosure of this patent document contains material which is subject to copyright protection. The owner has no objection to the facsimile reproduction by anyone of the patent disclosure, as it appears in the Patent and Trademark Office files or records, but otherwise reserves all copyright rights whatsoever.

FIELD OF INVENTION

The present invention relates to an apparatus that can be used to fold and secure a fabric article. The apparatus includes guide sections, cover sections, and fold sections. The guide sections and fold sections cooperate, to fold the fabric article and place it between the cover sections which in turn operates to secure the fabric article within the apparatus.

BACKGROUND

Folding fabric articles remains to be a manual operation by humans. It is considered a tedious chore and it requires substantial number of folding steps before the task is complete. The folding steps must also be performed accurately or the final shape of the folded fabric article will vary. The folded fabric article will, in general, require convenient packaging. Finally, multiple packaged fabric articles must be stored in such a way so as to allow easy recognition of the fabric article inside the package. Therefore, there is a need in the art for a fabric folding apparatus that allows convenient folding and packaging a fabric article that can be easily recognized while in storage.

SUMMARY

In one aspect, a polygon shaped fabric folding apparatus is disclosed wherein the apparatus comprises guide sections, comprising a top section, a middle section disposed below the top section, and a bottom section disposed below the middle section, cover sections, comprising a left-side section disposed to the left of the top section, and a right-side section disposed to the right of the top section, fold sections, comprising a first section between a top side of the bottom section and a bottom side of the middle section, a second section between a top side of the middle section and a bottom side of the top section, a third section between a left side of the top section and a right side of the left-side section, and a fourth section between a right side of the top section and a left side of the right-side section, wherein the guide sections operate to receive a fabric article and to cooperate with the fold sections to fold the fabric article and place the fabric article between the cover sections, and wherein the cover sections operate to secure the fabric article within the folding apparatus.

Preferably, the left-side section comprises a hook and the right-side section comprises a button, and wherein the hook operates to engage the button thereby latching the folding apparatus.

Preferably, the guide sections and the cover sections are made form a first flexible material and the fold sections are made form a second flexible material. Preferably, the first flexible material is hard plastic and the second flexible material is soft plastic. Preferably, the first flexible material is hard plastic and the second flexible material is stretch fabric.

Preferably, the guide sections are square shaped, the cover sections are rectangular shaped, and the fold sections are rectangular shaped. Preferably, the guide sections are square shaped having each side equal to 10 inches. Preferably, the cover sections are rectangular shaped having a length equal to 10 inches and width equal to 5 inches. Preferably, the fold sections are rectangular shaped having a length equal to 10 inches and width equal to 1.5 inches.

Preferably, the guide sections, the cover sections, and the fold sections have a thickness equal to 0.12 inches.

Preferably, the guide sections and the cover sections have a first thickness and the fold sections have a second thickness. Preferably, the first thickness is equal to 0.12 inches and the second thickness is equal to 0.06 inches.

Preferably, at least one of the third section and the fourth section has, a rectangular shaped window made from transparent material.

In another aspect, a method of folding and securing a fabric article within a polygon shaped fabric folding apparatus is disclosed, wherein the apparatus comprises guide sections, comprising a top section, a middle section disposed below the top section, and a bottom section disposed below the middle section, cover sections, comprising a left-side section disposed to the left of the top section, and a right-side section disposed to the right of the top section, fold sections, comprising a first section between a top side of the bottom section and a bottom side of the middle section, a second section between a top side of the middle section and a bottom side of the top section, a third section between a left side of the top section and a right side of the left-side section, and a fourth section between a right side of the top section and a left side of the right-side section, wherein the method comprises placing the fabric article on the middle section, folding the bottom section on the fabric article, folding a left-side section of the fabric article on the bottom section, folding a right-side section of the fabric article on the bottom section, folding the bottom section, the folded fabric article, and the middle section on the top section, folding the left-side section on the middle section, and folding the right-side section on the middle section.

Preferably, the left-side section comprises a hook and the right-side section comprises a button, wherein the method further comprises latching the apparatus by engaging the hook and the button.

DETAILED DESCRIPTION OF THE PRESENTLY PREFERRED EMBODIMENTS

Figure 1:
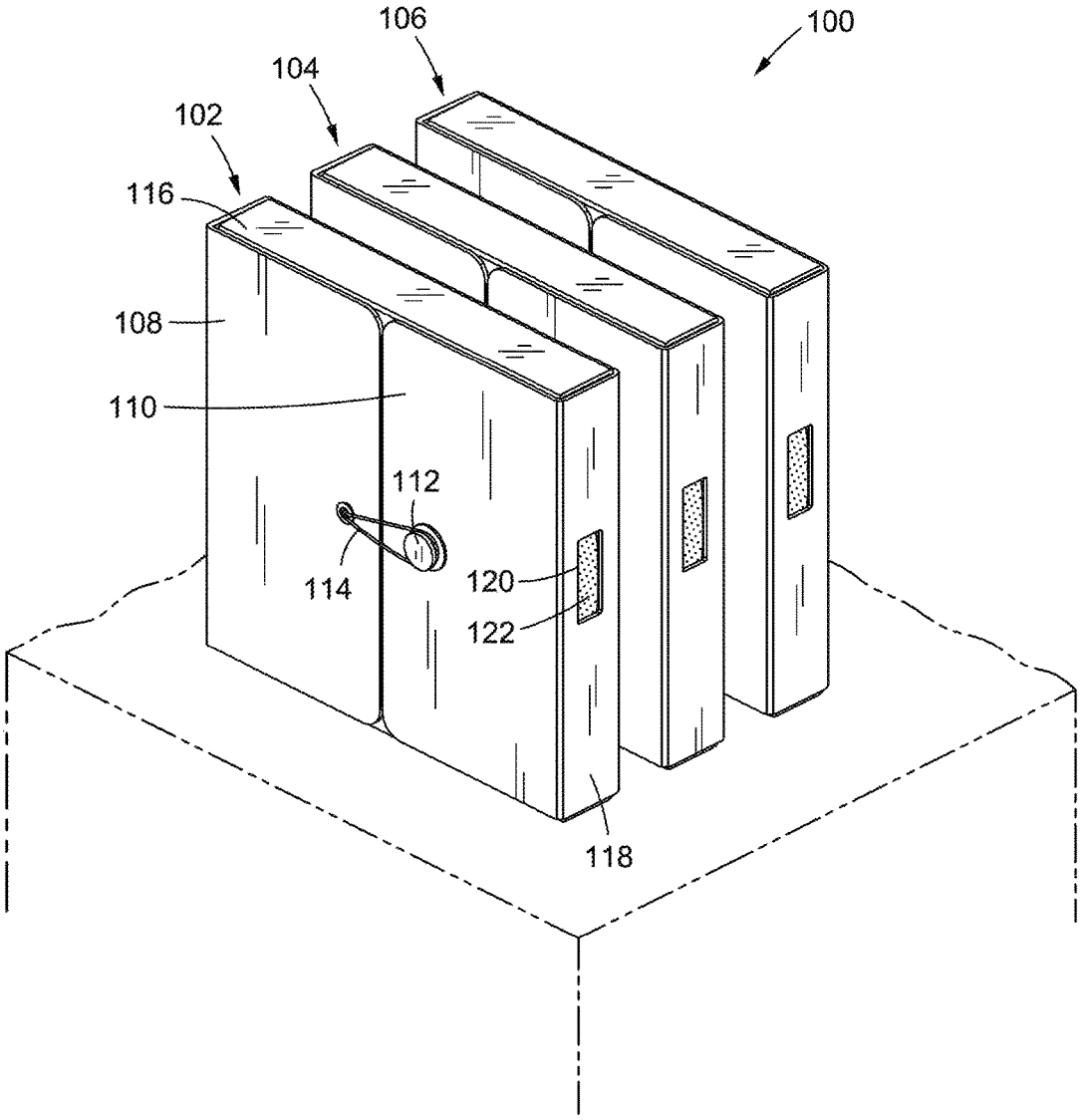
FIG. 1 shows a perspective view of a preferred embodiment of three fabric folding apparatuses according to the present invention.

FIG. 1 depicts a perspective view 100 of a preferred embodiment of three fabric folding apparatuses 102, 104, and 106 according to the present invention. Each of the folding, apparatuses 102, 104, 106 can be used to fold and secure a fabric article. The fabric article maybe of different sizes, different materials, and different colors. For instance, the apparatus 102 is used to fold and secure fabric article 122 inside the apparatus 102. A window 120 of the apparatus 102 provides a viewing aperture for the user to easily determine the color of the fabric article 122. As will be fully discussed below in connection with FIGS. 2 through 4, each of the fabric folding apparatuses 102, 104, 106 include guide sections, cover sections, and folding sections. Cover sections of the apparatus 102 include a left-side section 108 and a right-side section 110 which are utilized to secure the fabric article 122 within the apparatus 102. A hook 114 and a button 112 of the apparatus 102 are utilized to latch the left-side section 108 and the right-side section 110. Other types of latching mechanisms, such as Velcro fasteners, may be used to latch the cover sections.

Figure 2:
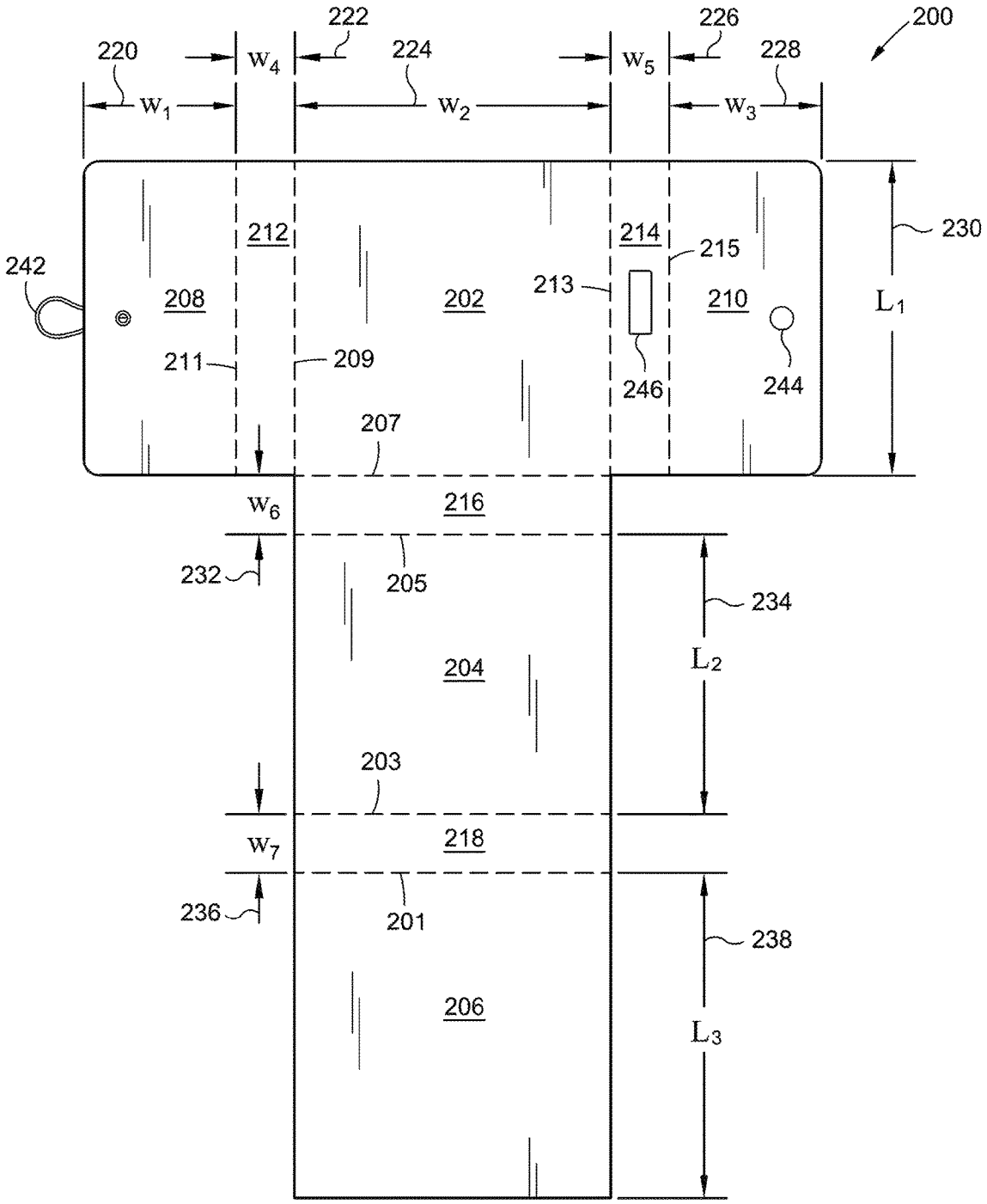
FIG. 2 shows a front view of a preferred embodiment of a fabric folding apparatus including guide sections, cover sections, and fold sections according to the present invention.

FIG. 2 depicts a front view of a preferred embodiment of a polygon shaped fabric folding apparatus 200 which is in its unfolded configuration. The apparatus 200 includes guide sections which comprise a top section 202, a middle section 204 which is disposed below the top section 202, and a bottom section 206 which is disposed below the middle section 204. The apparatus 200 further includes cover sections which comprise a left-side section 208 which is disposed to the left of the top section 202, and a right-side section 210 which is disposed to the right of the top section 202. The apparatus 200 further includes folding sections which comprise a first section 218, a second section 216, a third section 212, and a fourth section 214. The first section 218 is between a top side 201 of the bottom section 206 and a bottom side 203 of the middle section 204. The second section 216 is between a top side 205 of the middle section 204 and a bottom side 207 of the top section 202. The third section 212 is between a left side 209 of the top section 202 and a right side 211 of the left-side section 208. The fourth section 214 is between a right side 213 of the top section 202 and a left side 215 of the right-side section 210. As discussed fully below in connection with FIGS. 3A through 3E the bottom section 206, the middle section 204, and the top section 202 of the guide sections operate to receive a fabric article and will cooperate with the fold sections to fold the fabric article and place the fabric article between the cover sections, and wherein the cover sections operate to secure the fabric article within the folding apparatus 200.

In this preferred embodiment, the left-side section 208 includes a hook 242 and the right-side section 210 includes a button 244. The hook 208 operates to engage the button 242 to latch the folding apparatus 200. The fourth section 214 includes a window 246 which facilitates viewing of a fabric article (not shown) inside the apparatus 200 from the outside so as to provide a means to readily determine the color of the fabric article. For example, the window 246 is rectangular and it is made from a transparent material.

In this preferred embodiment, the guide sections which comprise the top section 202, the middle section 204, and the bottom section 206, and the cover sections which comprise the left-side section 208 and the right-side section 210 are made from a first flexible material. For example, the first flexible material is hard plastic. The fold sections which comprise the first section 218, the second section 216, the third section 212, and the fourth section 214 are made from a second flexible material. For example, the second flexible material is soft plastic. In an alternative embodiment, the second flexible material is stretch fabric. In an alternative embodiment, the guide sections, the cover sections, and the fold sections are made from the same material, for instance soft plastic.

In this preferred embodiment, the guide sections which comprise the top section 202, the middle section 204, and the bottom section 206 are square shaped. Specifically, the top section 202 has sides L1 at 230 and W2 at 224 which are equal. The middle section 204 has a side L2 at 234, which is equal to the side L1 at 230, and the side W2 at 224. The bottom section 206 has a side L3 at 238, which is equal to the side L2 at 234 which is equal to the side L1 at 230, and the side W2 at 224. For instance, the sides L1 at 230, L2 at 234, L3 at 238, and W2 at 224 are equal to 10 inches. The cover sections which comprise the left-side section 208 and the right-side section 210 are rectangular in shape. Specifically, the left-side section 208 has the side L1 at 230 and a side W1 at 220. The right-side section 210 has the side L1 at 230 and a side W3 at 228. For instance, the sides W1 at 220 and W3 at 228 are equal to 5 inches. The fold sections which comprise the first section 218, the second section 216, the third section 212, and the fourth section 214 are rectangular shaped. Specifically, the first section 218 has a side W7 at 236 and the side W2 at 224. The second section 216 has a side W6 at 232 and the side W2 at 224. The third section 212 has a side W4 at 222 and the side L1 at 230. The fourth section 214 has a side W5 at 226 and the side L1 at 230. For instance, the sides W7 at 236 and W6 at 232 and W4 at 222 and W5 at 226 are equal to 1.5 inches.

In this preferred embodiment, the guide sections which comprise the top section 202, the middle section 204, and the bottom section 206, the cover sections which comprise the left-side section 208 and the right-side section 210, and the fold sections which comprise the first section 218, the second section 216, the third section 212, and the fourth section 214 all have the same thickness (not shown in this figure), for example 0.12 inches. In an alternative embodiment, the guide sections which comprise the top section 202, the middle section 204, and the bottom section 206, and the cover sections which comprise the left-side section 208 and the right-side section 210 all have the same thickness t1 (not shown in this figure but see, for instance, FIG. 4B), for example, 0.12 inches. The fold sections which comprise the first section 218, the second section 216, the third section 212, and the fourth section 214 all have the same thickness t2 (not shown in this figure but see, for instance, FIG. 4B), for example, 0.06 inches.

Figure 3A:
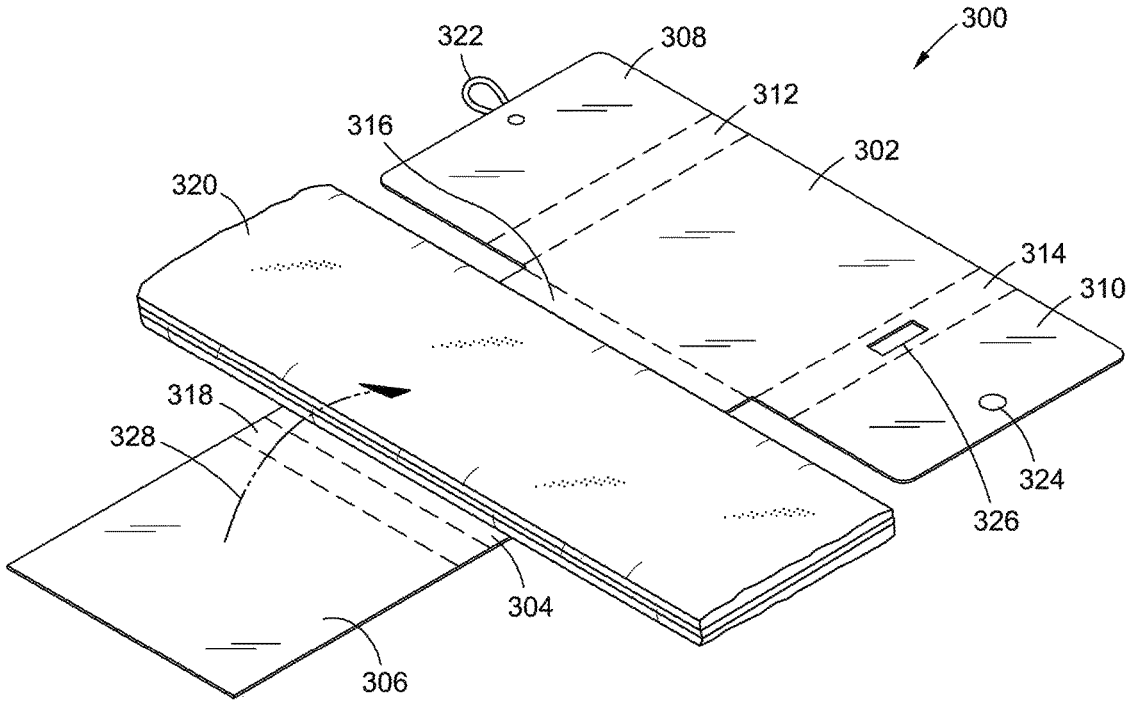
FIG. 3A shows a perspective view of a preferred embodiment of a fabric folding apparatus being utilized to fold and secure a fabric article. The motion arrow indicates a preferred step of folding and securing the fabric article within the apparatus.

FIG. 3A depicts a perspective view of a preferred embodiment of a polygon shaped fabric folding apparatus 300 being utilized to fold and secure a fabric article 320. A motion arrow 328 indicates a preferred step of folding and securing the fabric article 320 within the apparatus 300. The apparatus 300 includes guide sections which comprise a top section 302, a middle section 304, and a bottom section 306. The apparatus 300 further includes cover sections which comprise a left-side section 308 and a right-side section 310. The apparatus 300 further includes folding sections which comprise a first section 318, a second section 316, a third section 312, and, a fourth section 314. The fabric article 320 has a rectangular shape and it is placed centrally on the middle section 304 of the guide section of the apparatus 300. In this preferred embodiment, the left-side section 308 includes a hook 322 and the right-side section 310 includes a button 324. The hook 308 operates to engage the button 324 to latch the folding apparatus 300. The fourth section 314 includes a window 326 which facilitates viewing of the fabric article 320 inside the apparatus 300 from the outside so as to provide a means to readily determine the color of the fabric article. The window 326 is rectangular and it is made from a transparent material such as transparent nylon. According to this step, the bottom section 306 and first section 318 cooperate to fold the bottom section 306 on the fabric article 320.

Figure 3B:
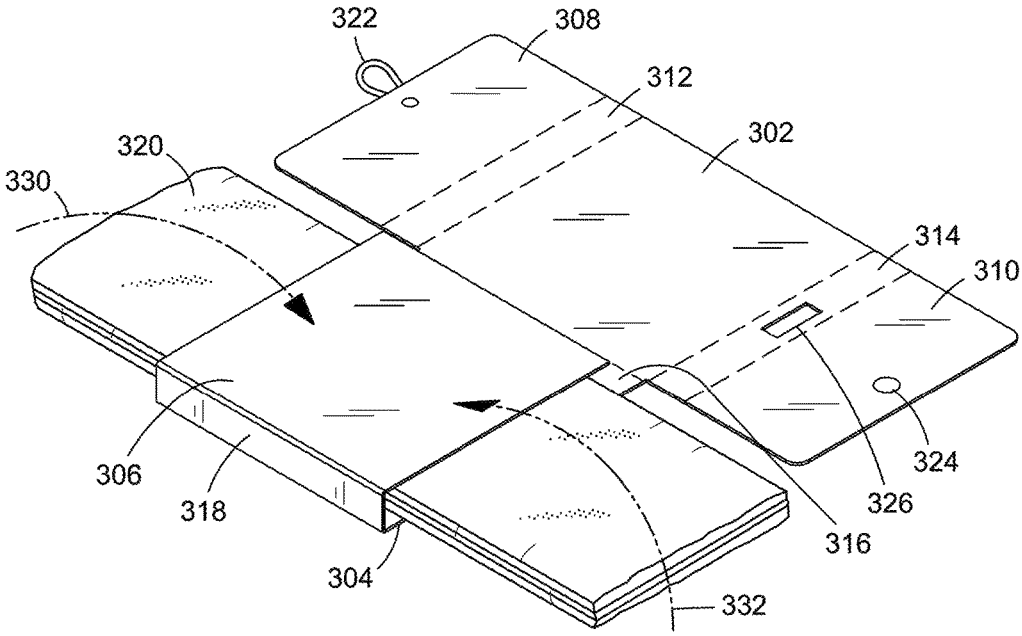
FIG. 3B shows the fabric folding apparatus of FIG. 3A, the motion arrows indicating further preferred steps of folding and securing the fabric article within the apparatus.

FIG. 3B depicts the fabric folding apparatus 300 of FIG. 3A and motion arrows 330 and 332 indicate further preferred steps of folding and securing the fabric article 320 within the apparatus 300. The motion arrow 330 shows that a left-side section of the fabric article 320 is folded on the bottom section. The motion arrow 332 shows that a right-side section of the fabric article 320 is folded on the bottom section 306. The first section 318 has a width that can easily accommodate the thickness of the fabric article 320.

Figure 3C:
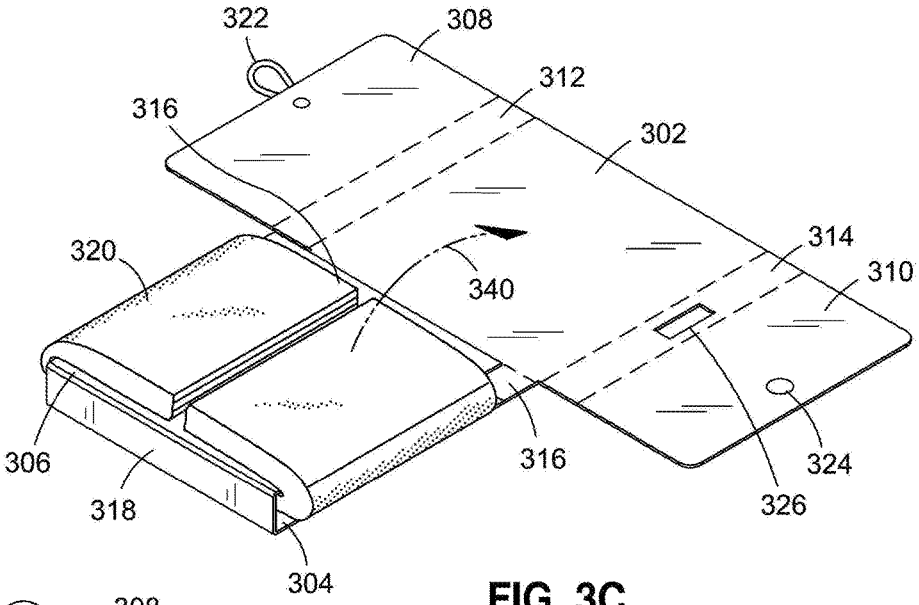
FIG. 3C shows the fabric folding apparatus of FIG. 3B, the motion arrow indicating a further preferred step of folding and securing the fabric article within the apparatus.

FIG. 3C depicts the fabric folding apparatus 300 of FIG. 3B and a motion arrow 340 indicates a further preferred step of folding and securing the fabric article 320 within the apparatus 300. The motion arrow 340 shows that the bottom section 306, the folded fabric article 320, and the middle section 304 are folded on the top section 302. The second section 316 has a width that can easily accommodate the thickness of the folded fabric article 320 and the thickness of the bottom section 306.

Figure 3D:
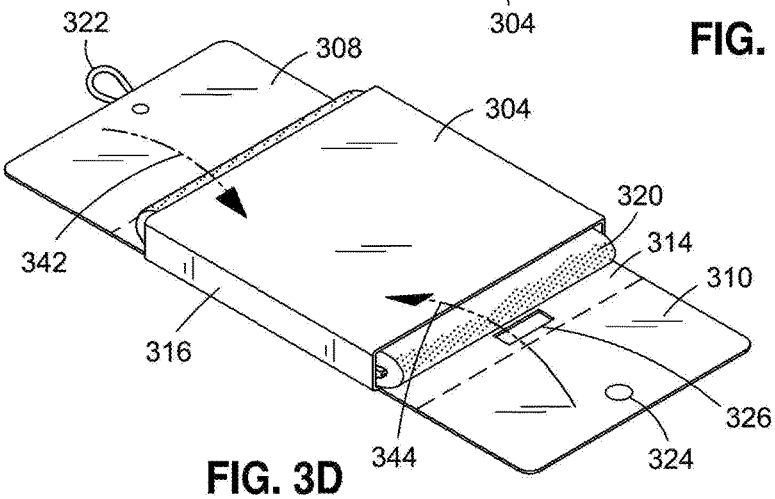
FIG. 3D shows the fabric folding apparatus of FIG. 3C, the motion arrows indicating further preferred steps of folding and securing the fabric article within the apparatus.

FIG. 3D depicts the fabric folding apparatus 300 of FIG. 3C and motion arrows 342 and 344 indicate further preferred steps of folding and securing the fabric article 320 within the apparatus 300. The motion arrow 342 shows the left-side section 308 of the cover section is folded on the middle section 304. The motion arrow 344 shows that the right-side section 310 of the cover section is folded on the middle section 304. The third section 312 and the fourth section 314 have a width that can easily accommodate the thickness of the folded fabric article 320, the thickness of the bottom section 306, and the thickness of the middle section 304. The window 326 allows one to see the color of the folded fabric article 320 inside the apparatus 300.

Figure 3E:
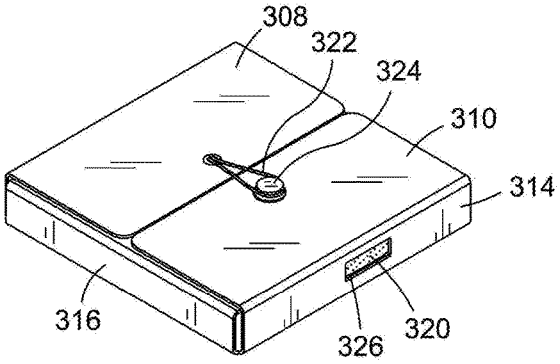
FIG. 3E shows the fabric folding apparatus of FIG. 3D indicating a further preferred step of folding and securing the fabric article within the apparatus.

FIG. 3E depicts the fabric folding apparatus 300 of FIG. 3D indicating a further preferred step of folding and securing the fabric article 320 within the apparatus 300. Specifically, the step includes latching the apparatus 300 by engaging the hook 322 and the button 324. The apparatus 300 so latched can now be stored conveniently, neatly, and efficiently.

Figures 4A, 4B:
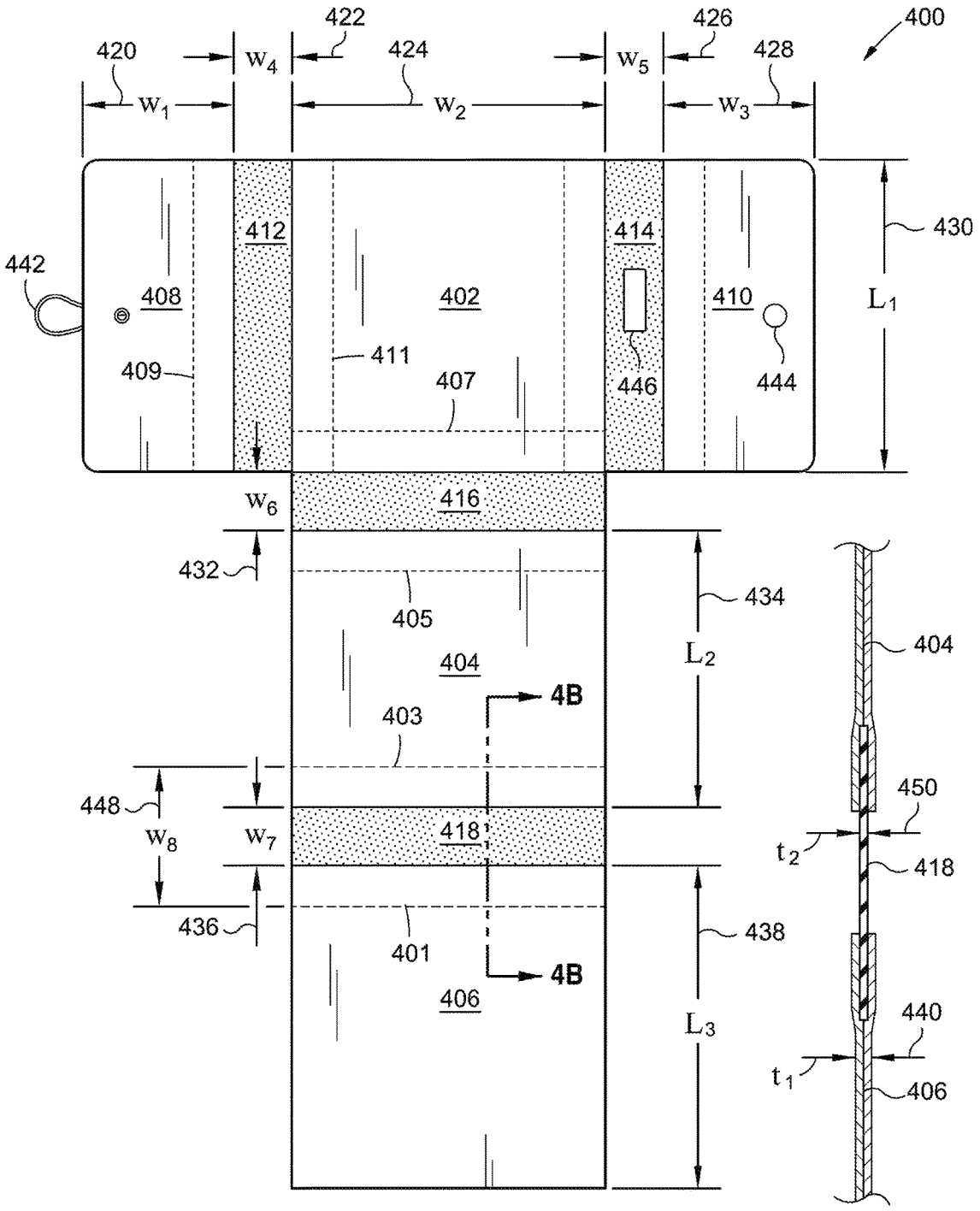
FIG. 4A shows a front view of a preferred embodiment of a fabric folding apparatus including guide sections, cover sections, and fold sections according to the present invention.
FIG. 4B shows a partial cross sectional view of a preferred embodiment of a bottom section and a middle section of the guide sections and a first section of the fold sections of the fabric folding apparatus of FIG. 4A.

FIG. 4A depicts a front view of a preferred embodiment of a polygon shaped fabric folding apparatus 400 which is in its unfolded configuration. The apparatus 400 includes guide sections which comprise a top section 402, a middle section 404, and a bottom section 406, similar to that in FIG. 2. The apparatus 400 further includes cover sections which comprise a left-side section 408 and a right-side section 410. The apparatus 400 further includes fold sections which comprise a first section 418, a second section 416, a third section 412, and a fourth section 414. The left-side section 408 includes a hook 442 and the right-side section 410 includes a button 444. The fourth section 414 includes a window 446. The guide sections are made from a first flexible material, for instance, hard plastic. The fold sections are made from a second flexible material, for instance, stretch fabric, such as a mesh. In this preferred embodiment, the geometries of the guide sections and cover sections are similar to the apparatus 200 in FIG. 2. However, the fold sections which comprise the first section 418, the second section 416, the third section 412, and the fourth section 414 have a different width than that shown in FIG. 2. Specifically, the widths of the fold sections are larger so as to allow them to be partially embedded inside the neighboring sections. For instance, the first section 418 has a width that is defined as the distance W8 at 448 between a side 401 and a side 403, the second section 416 has a width that is defined as the distance between a side 405 and a side 407, the third section 412 has a width that is defined as the distance between a side 409 and a side 411, and the fourth section 414 has a width that is defined as the distance between a side 413 and, a side 415. These fold sections are partially embedded inside their neighboring sections (see FIG. 4B). Widths W7 at 436, W6 at 432, W4 at 422, and W5 at 426 of the fold sections are unembedded.

FIG. 4B depicts a partial cross sectional view of a preferred embodiment of the bottom section 406 and the middle section 404 of the guide sections and the first section 418 of the fold sections of the fabric folding apparatus 400 of FIG. 4A. In particular, the first section 418 is embedded in the bottom section 406 and the middle section 404. The bottom section 406 and the middle section 404 has a thickness t1 at 440 and the first section 418 has a thickness t2 at 450. For instance, the thickness t1 at 440 is equal to 0.12 inches and the thickness t2 at 450 is equal to 0.06 inches.

The foregoing explanations, descriptions, illustrations, examples, and discussions have been set forth to assist the reader with understanding this invention and further to demonstrate the utility and novelty of it and are by no means restrictive of the scope of the invention. It is the following claims, including all equivalents, which are intended to define the scope of this invention.

What is claimed is:

1. A method of folding and securing a fabric article within a polygon shaped fabric folding apparatus, said apparatus comprising:

(a) guide sections, comprising:

(i) a top section;

(ii) a middle section disposed below the top section; and (iii) a bottom section disposed below the middle section;

(b) cover sections, comprising:

(i) a left-side section disposed to the left of the top section; and (ii) a right-side section disposed to the right of the top section;

(c) fold sections, comprising (i) a first section between a top side of the bottom section and a bottom side of the middle section;

(ii) a second section between a top side of the middle section and a bottom side of the top section;

(iii) a third section between a left side of the top section and a right side of the left-side section; and (iv) a fourth section between a right side of the top section and a left side of the right-side section;

said method comprising:

(A) placing the fabric article on the middle section;

(B) folding the bottom section on the fabric article;

(C) folding a left-side section of the fabric article on the bottom section;

(D) folding a right-side section of the fabric article on the bottom section;

(E) folding the bottom section, the folded fabric article, and the middle section on the top section;

(F) folding the left-side section on the middle section; and (G) folding the right-side section on the middle section.

2. The method of claim 1, wherein the left-side section comprises a hook and the right-side section comprises a button, said method further comprising:

(H) latching the apparatus by engaging the hook and the button.

3. The method of claim 1, wherein the guide sections and the cover sections are made form a first flexible material and the fold sections are made form a second flexible material.

4. The method of claim 3, wherein the first flexible material is hard plastic and the second flexible material is soft plastic.

5. The method of claim 3, wherein the first flexible material is hard plastic and the second flexible material is stretch fabric.

6. The method of claim 1, wherein the guide sections are square shaped, the cover sections are rectangular shaped, and the fold sections are rectangular shaped.

7. The method of claim 1, wherein the guide sections and the cover sections have a first thickness and the fold sections have a second thickness.

* * * * *